US011297693B2

(12) United States Patent
Zhang

(10) Patent No.: US 11,297,693 B2
(45) Date of Patent: Apr. 5, 2022

(54) THERMOSTATIC GARMENT BEING HEATED AND COOLED BY POWER SUPPLY

(71) Applicant: Jianping Zhang, Beijing (CN)

(72) Inventor: Jianping Zhang, Beijing (CN)

( * ) Notice: Subject to any disclaimer, the term of this patent is extended or adjusted under 35 U.S.C. 154(b) by 326 days.

(21) Appl. No.: 16/584,965

(22) Filed: Sep. 27, 2019

(65) Prior Publication Data

US 2020/0268064 A1 Aug. 27, 2020

(30) Foreign Application Priority Data

Feb. 25, 2019 (CN) ..... 201910143711.7

(51) Int. Cl.

| | |
|---|---|
| ***A41D 13/005*** | (2006.01) |
| ***H05B 3/34*** | (2006.01) |
| ***F28D 1/053*** | (2006.01) |
| ***F28F 1/12*** | (2006.01) |
| ***F25B 21/02*** | (2006.01) |
| ***F25D 31/00*** | (2006.01) |
| *F28D 15/00* | (2006.01) |
| *H05B 1/02* | (2006.01) |
| *A62B 17/00* | (2006.01) |

(52) U.S. Cl.

CPC ..... *H05B 3/342* (2013.01); *A41D 13/0051* (2013.01); *A41D 13/0053* (2013.01); *F25B 21/02* (2013.01); *F25D 31/005* (2013.01); *F28D 1/05325* (2013.01); *F28F 1/126* (2013.01); *A62B 17/005* (2013.01); *F25B 2321/021* (2013.01); *F25D 2400/26* (2013.01); *F28D 15/00* (2013.01); *F28F 2250/08* (2013.01); *H05B 1/0272* (2013.01); *H05B 2203/036* (2013.01)

(58) Field of Classification Search

CPC ..... H05B 3/342; H05B 2203/036; H05B 1/0272; A41D 13/0051; A41D 13/0053; F25D 2400/26; F25B 21/02; H01L 35/00; H01L 37/00

See application file for complete search history.

(56) References Cited

U.S. PATENT DOCUMENTS 4,998,415 A * 3/1991 Larsen ..... A41D 13/0053 62/231

2009/0264969 A1* 10/2009 Gammons ..... A61F 7/02 607/104

(Continued)

*Primary Examiner* — Lionel Nouketcha

(74) *Attorney, Agent, or Firm* — Bayramoglu Law Offices LLC

(57) ABSTRACT

A thermostatic garment being heated and cooled by a power supply and includes a thermostatic garment body. A first heat exchange water pipe network and a second heat exchange water pipe network are arranged on the thermostatic garment body in a laying manner. A thermoelectric cooler, an electric heating sheet, a controller, a power supply, a first water pump, a second water pump, a first heat conducting water tank, and a second heat conducting water tank are arranged outside the thermostatic garment body. The first heat conducting water tank is provided with a first temperature sensor, and the first temperature sensor is electrically connected to an input end of the controller. Output ends of the controller is further electrically connected to the thermoelectric cooler, the electric heating sheet and the water pump respectively. The electric heating sheet is connected to the first heat conducting water tank.

12 Claims, 10 Drawing Sheets

(56) References Cited

U.S. PATENT DOCUMENTS

| | | | | |
|---|---|---|---|---|
| 2010/0084125 | A1* | 4/2010 | Goldstein | F17C 11/00 165/287 |
| 2012/0227432 | A1* | 9/2012 | Creech | A41D 13/0053 62/259.3 |

* cited by examiner

THERMOSTATIC GARMENT BEING HEATED AND COOLED BY POWER SUPPLY

CROSS REFERENCE TO THE RELATED APPLICATIONS

This application is based upon and claims priority to Chinese Patent Application No. 201910143711.7, filed on Feb. 25, 2019, the entire contents of which are incorporated herein by reference.

TECHNICAL FIELD

The present disclosure relates to the technical field of a functional garment and more specifically to a thermostatic garment being heated and cooled by a power supply.

BACKGROUND

When working in summer in construction sites, high-temperature workshops, field operations, catering kitchens, and other environments, the temperature is very high and often reaches 40° C. or even 50° C. or more. These high temperatures make it hard to work continuously which reduces work efficiency and can cause health problems to the people working in these high temperature environments. While working in winter in field operations, ice storage operations and other cold temperature environments, cold winds and cold air torment operators working in these very cold conditions, thereby leading to a drop in body temperature, trembling of the extremities, finger stiffness, poor action accuracy, reduced efficiency of work and even causing diseases and damage to the operators' health. Therefore, working in high and cold temperature operations the operator's health is an urgent labor problem that needs to be solved. Currently, various temperature-changing garments attempt to solve the above technical problems. For example, the following four technical solutions are provided by the prior art.

Technical solution 1: As shown in FIG. 11, a garment adopting the ice (cold water) bags 16, is brought into contact with the body through the pre-installed ice (cold water) bags 16 to achieve the purpose of cooling the body. Technical solution 1 requires the body to carry the pre-installed ice (cold water) bags 16. The pre-installed ice (cold water) bags 16 are heavy and cannot continue to provide cooling after the temperature of the ice (cold water) bags 16 rises to and above the body temperature. Moreover, the garment has no heating function and also cannot operate like a thermostat.

Technical solution 2: As shown in FIG. 12, a garment being cooled by circulating water includes a garment body, the first heat exchange water pipe network 4, the first connecting water pipe 5, the first water pump 10-1, the first heat conducting water tank 11-1, the controller and a power supply 17. A lower temperature water in the first heat conducting water tank 11-1 is driven by the first water pump 10-1 into the first heat exchange water pipe network 4 connected with the garment body, thereby taking away the body heat. In the present solution, the water in the first heat conducting water tank 11-1 cannot be cooled and only can be pre-stored as much as possible through a water supply port 18 of the water tank in order to work as long as possible. As a result, the garment is heavy, large in size, is inconvenient to carry and the working time is short. The garment cannot operate like a thermostat and has no heating function.

Technical solution 3: As shown in FIG. 13, a garment being cooled by a compressor includes a garment body, the first heat exchange water pipe network 4, the first connecting water pipe 5, the first heat conducting water tank 11-1, the evaporator 19, the first water pump 10-1, the controller 8, the power supply 9, the condenser 110, the fan 120 and the refrigeration compressor 130. Heat is absorbed by the refrigeration compressor 130 through the evaporator 19 to lower the temperature of the water in the first heat conducting water tank 11-1. The cold water is driven by the first water pump 10-1 to circulate in the first heat exchange water pipe network 4, thereby achieving the purpose of cooling the body. The present solution requires the use of a compressor and has a presence of moving parts, thus making the garment heavy and large in size. The heat of the compressors' condenser 110 needs to be dissipated by the fan 120, thus resulting in a loud noise. As a result, the heat dissipation effect of the garment is limited and the garment has no heating function.

Technical solution 4: As shown in FIG. 14, a garment being heated by an electric heating wire includes a garment body, the heating wire network 140, the electric wire 150, a controller and the power supply 17. The purpose of warming up the body is achieved by heating the heating wire arranged on the garment. However, technical solution 4 has no cooling function.

SUMMARY

The present disclosure provides a thermostatic garment being heated and cooled by a power supply. The thermostatic garment solves the defects of the existing functional garments. Existing functional garments have several defects such as not having both heating and cooling functions, the poor heat dissipation effect and inconvenience in carrying.

A thermostatic garment is heated and cooled by a power supply and includes:

a thermostatic garment body, a first heat exchange water pipe network, a second heat exchange water pipe network, a thermoelectric cooler, an electric heating sheet, a controller, a power supply, a first connecting water pipe, a second connecting water pipe, a water pump and a heat conducting water tank. The heat conducting water tank includes a first heat conducting water tank and a second heat conducting water tank. The water pump includes a first water pump and a second water pump.

The thermostatic garment body includes a thermostatic garment inner layer and a thermostatic garment outer layer. The first heat exchange water pipe network is arranged on the thermostatic garment inner layer in a laying manner, and the second heat exchange water pipe network is arranged on the thermostatic garment outer layer in a laying manner. The thermoelectric cooler, the electric heating sheet, the controller, the power supply, the water pump and the heat conducting water tank are all arranged outside the thermostatic garment body.

The first heat conducting water tank is provided with a first temperature sensor and the first temperature sensor is electrically connected to an input end of the controller. The first temperature sensor, the thermoelectric cooler, the electric heating sheet, the controller, the first water pump, and the second water pump are all connected to the power supply. Output ends of the controller are further electrically connected to the thermoelectric cooler, the electric heating sheet, the first water pump and the second water pump respectively.

The thermoelectric cooler can work in two work modes of heating and cooling. One of a cold end and a hot end of the thermoelectric cooler is connected to the first heat conducting water tank, and another one of the cold end and the hot end of the thermoelectric cooler is connected to the second heat conducting water tank. A water inlet end of the first water pump is connected to a water outlet of the first heat conducting water tank. A water outlet end of the first water pump is connected to one end of the first connecting water pipe, another end of the first connecting water pipe is connected to a water inlet of the first heat exchange water pipe network. A water outlet of the first heat exchange water pipe network is connected to a water inlet of the first heat conducting water tank. The first heat conducting water tank is further connected with the electric heating sheet. A water inlet end of the second water pump is connected to a water outlet of the second heat conducting water tank. A water outlet end of the second water pump is connected to one end of the second connecting water pipe and another end of the second connecting water pipe is connected to a water inlet of the second heat exchange water pipe network. A water outlet of the second heat exchange water pipe network is connected to a water inlet of the second heat conducting water tank. A closed loop waterway is formed by the second heat conducting water tank, the second heat exchange water pipe network and the second water pump.

Preferably, the thermostatic garment body further includes a thermostatic garment heat insulating layer, and the thermostatic garment heat insulating layer is arranged between the thermostatic garment inner layer and the thermostatic garment outer layer.

Preferably, a water-cooled radiator and a cooling fan are additionally arranged in series on one end of the second connecting water pipe close to the second water pump. A water-cooled radiator water inlet is connected to the water outlet end of the second water pump through a water pipe and a water outlet of the water-cooled radiator is connected to the water inlet of the second heat exchange water pipe network through a water pipe. The cooling fan and the water-cooled radiator are arranged in parallel, and the cooling fan is controlled to operate by the controller.

Preferably, the thermostatic garment further includes a thermoelectric cooler driving circuit, wherein an input end of the controller is connected to the first temperature sensor, and an output end of the controller is connected to an input end of the thermoelectric cooler driving circuit. An output end of the thermoelectric cooler driving circuit is connected to the thermoelectric cooler. A first preset temperature signal is preset and stored by the controller. A temperature signal collected by the first temperature sensor is compared with the first preset temperature signal by the controller. The direction and magnitude of an electric current flowing into the thermoelectric cooler is controlled by software according to a comparison result; and a second water pump driving circuit and a cooling fan driving circuit, wherein an input end of the second water pump driving circuit and an input end of the cooling fan driving circuit are both connected to output ends of the controller. An output end of the second water pump driving circuit is connected to the second water pump and an output end of the cooling fan driving circuit is connected to the cooling fan.

Preferably, the water-cooled radiator includes:

a water-cooled radiator housing, wherein the water-cooled radiator housing includes a plurality of connecting plates, and the plurality of connecting plates form an accommodating chamber. The water-cooled radiator housing has a water collecting area on a side of the accommodating chamber, wherein one of the connecting plates is provided with a water-cooled radiator water inlet and a water-cooled radiator water outlet. The water-cooled radiator water inlet and the water-cooled radiator water outlet are arranged in the water collecting area, and the water-cooled radiator water inlet and the water-cooled radiator water outlet are both in communication with the accommodating chamber;

a heat exchange module, wherein the heat exchange module is arranged in the accommodating chamber, and the heat exchange module include a plurality of wavy cooling fins;

a water inlet pipe, wherein the water inlet pipe is inserted in the water-cooled radiator water inlet. One end of the water inlet pipe is exposed outside the water-cooled radiator housing and another end of the water inlet pipe extends from the water-cooled radiator water inlet into the accommodating chamber;

a water outlet pipe, wherein the water outlet pipe is inserted in the water-cooled radiator water outlet and one end of the water outlet pipe is exposed outside the water-cooled radiator housing, an another end of the water inlet pipe extends from the water-cooled radiator water outlet into the accommodating chamber. The water outlet pipe has a water outlet side hole at an end extending into the accommodating chamber. A structure of the water-cooled radiator can prevent air from entering the water outlet pipe by covering the water outlet side hole through the water in the accommodating chamber; and a partition plate, wherein the partition plate is arranged in the accommodating chamber and located between the water inlet pipe and the water outlet pipe. Two opposite inner wall surfaces of the accommodating chamber are connected by the partition plate.

Preferably, the thermoelectric cooler includes:

an array structure formed by a plurality of P-type semiconductors and a plurality of N-type semiconductors connected in series, wherein the P-type semiconductors and N-type semiconductors are spaced apart. The P-type semiconductors and the N-type semiconductors are adjacent to each other but do not contact one another; and an upper heat conducting layer and a lower heat conducting layer are arranged opposite to each other, wherein the upper heat conducting layer and the lower heat conducting layer are respectively additionally arranged on an upper end and a lower end of the array structure. The upper heat conducting layer is fixedly connected with at least one conductive metal sheet. The lower heat conducting layer is fixedly connected with at least two conductive metal sheets, and the number of the conductive metal sheets, fixedly connected to the lower heat conducting layer, is one more than the number of the conductive metal sheets fixedly connected to the upper heat conducting layer. One N-type semiconductor and one P-type semiconductor are fixed on each of the conductive metal sheets on the upper heat conducting layer, and another end of the N-type semiconductor element and another end the P-type semiconductor element fixed on the same conductive metal sheet on the upper heat conducting layer are respectively fixed on two adjacent conductive metal sheets on the lower heat conducting layer. The conductive metal sheets on the left and right ends of the lower heat conducting layer are connected to the positive and negative poles of a direct current power supply, and ends of the upper heat conducting layer and the lower heat conducting layer, away from the array structure, are respectively connected to the first heat conducting water tank and the second heat conducting water tank.

Preferably, a closed accommodating space is formed between the upper heat conducting layer and the lower heat conducting layer. The corresponding edges of the upper heat conducting layer and the lower heat conducting layer are bonded. The array structure is located in the accommodating space and in the array structure. The plurality of P-type semiconductors and the plurality of N-type semiconductors are collinearly arranged along an arrangement direction of the array. The P-type semiconductors and the N-type semiconductors are spaced apart in the accommodating space. A first gap is arranged between the adjacent P-type semiconductors and the N-type semiconductors. A second gap is arranged between the adjacent P-type semiconductors. A third gap is arranged between the adjacent N-type semiconductors. An inert gas is filled in the first gap, the second gap and the third gap.

Preferably, a material of the upper heat conducting layer and the lower heat conducting layer are both alumina ceramic.

Preferably, further including an electronic device, the electronic device includes:

a liquid crystal display panel;

an up selection button, a down selection button and a confirmation button, wherein the up selection button, the down selection button and the confirmation button are all hard buttons; and a microprocessor, wherein the liquid crystal display panel, the up selection button, the down selection button, the confirmation button and the controller are all connected to the microprocessor.

The technical solution of the present disclosure has the following advantages.

1. Cooling Operation Mode of the Thermostatic Garment:

A positive pole of the power supply is connected to the N-type semiconductor of the thermoelectric cooler, and a negative pole of the power supply is connected to the P-type semiconductor of the thermoelectric cooler. The thermoelectric cooler absorbs heat on one side of the first heat conducting tank connected to the thermostatic garment inner layer, thereby lowering the temperature of the water in the first heat conducting water tank. The cold water in the first heat conducting water tank is driven by the first water pump connected to the thermostatic garment inner layer to circulate and flow in the first heat exchange water pipe network of the thermostatic garment inner layer through the first connecting water pipe, thereby taking away the body heat. At the same time, the thermoelectric cooler is heated on one side of the second heat conducting water tank connected to the thermostatic garment outer layer, thereby raising the temperature of the second heat conducting water tank. The hot water in the second heat conducting water tank is driven by the second water pump connected to the thermostatic garment outer layer to circulate and flow in the second heat exchange water pipe network of the thermostatic garment outer layer and the heat dissipation effect is achieved by contact with the outside air. The present technical solution has the advantages of good heat dissipation. The temperature of the water in the first heat conducting water tank is monitored by the first temperature sensor used by the controller, and the power supply of the thermoelectric cooler is controlled (e.g. controlling the current direction and magnitude of the cooling sheet) to obtain a constant temperature according to the water temperature.

2. Heating Operation Mode of the Thermostatic Garment:

The direction of the power supply of the thermoelectric cooler is switched. The positive pole of the power supply is connected to the P-type semiconductor of the thermoelectric cooler, and the negative pole of the power supply is connected to the N-type semiconductor of the thermoelectric cooler. The thermoelectric cooler is heated on one side connected to the first heat conducting water tank, thereby raising the temperature of the water in the first heat conducting water tank. The hot water in the first heat conducting water tank is driven by the first water pump connected to the thermostatic garment inner layer to circulate and flow in the first heat exchange water pipe network of the thermostatic garment inner layer through the first connecting water pipe, thereby providing heat to the body. At the same time, the thermoelectric cooler is providing cooling on one side of the second heat conducting water tank, thereby lowering the temperature of the second heat conducting water tank. The cold water in the second heat conducting water tank is driven by the second water pump into the second heat exchange water pipe network on the thermostatic garment outer layer to circulate and flow, and the heat exchange is achieved by contacting outside air. The temperature of the water in the first heat conducting water tank is monitored by the first temperature sensor used by the controller, and the power supply of the thermoelectric cooler is controlled (e.g. controlling the current direction and magnitude of the thermoelectric cooler) to obtain a constant temperature according to the water temperature.

Another heating operation mode of the thermostatic garment body:

The electric heating sheet is heated by the power supply, thereby raising the temperature of the water in the first heat conducting water tank. The hot water in the first heat conducting water tank is driven by the first water pump to circulate and flow in the first heat exchange water pipe network of the thermostatic garment inner layer through the first connecting water pipe, thereby providing heat to the body. The temperature of the water in the first heat conducting water tank is monitored by the first temperature sensor used by the controller, and the power supply of the electric heating sheet is controlled to obtain a constant temperature according to the water temperature.

In summary, the thermostatic garment of the present disclosure adopts a thermoelectric cooler for cooling and heating and can be heated by an electric heating sheet as well. The cooled or heated water is driven by the first water pump to circulate in the first heat exchange water pipe network arranged on the thermostatic garment inner layer in a laying manner, thereby achieving the function of cooling or heating the body. Due to the use of electric heating or cooling, it is not necessary to pre-install a large amount of water in the first heat conducting water tank, thereby reducing the volume and the weight of the water tank which makes the thermostatic garment convenient to carry. The adopted thermoelectric cooler and the electric heating sheet have the advantages of small volume, light weight, no moving parts, high efficiency, stable and reliable operation, and further makes the thermostatic garment convenient to carry. In addition, when the thermoelectric cooler is heated on one side of the second heat conducting tank, the temperature of the second heat conducting tank increases. The hot water in the second heat conducting water tank is driven by the second water pump to circulate and flow in the second heat exchange water pipe network, and the heat is dissipated by contact with the outside air. The present technical solution adopts water circulation for heat dissipation in the heat exchange water pipe network and has the advantages of good heat dissipation owing to the large contact area with the ambient air and does not require the use of a fan for cooling, thereby reducing noise and improving reliability.

Other features and advantages of the present disclosure will be illustrated in the following description. Moreover, partially obvious from the specification, or understood by implementing the present disclosure. The objective and other advantages of the present disclosure may be achieved and obtained by the structure particularly indicated in the specification, claims, and appended drawings.

The technical solution of the present disclosure will be further described in detail below through the drawings and embodiments.

BRIEF DESCRIPTION OF THE DRAWINGS

The drawings are intended to provide a further understanding of the present disclosure and form a part of the specification. The drawings are used to illustrate the present disclosure together with the embodiments of the present disclosure and are not intended to limit the present disclosure. In the drawings.

Figure 1:
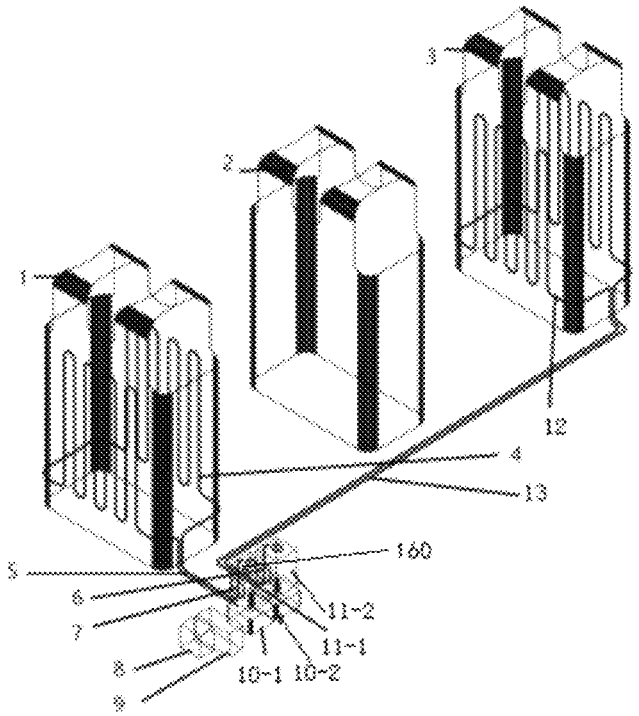
FIG. 1 is a schematic structural view of the present disclosure.
Figure 2:
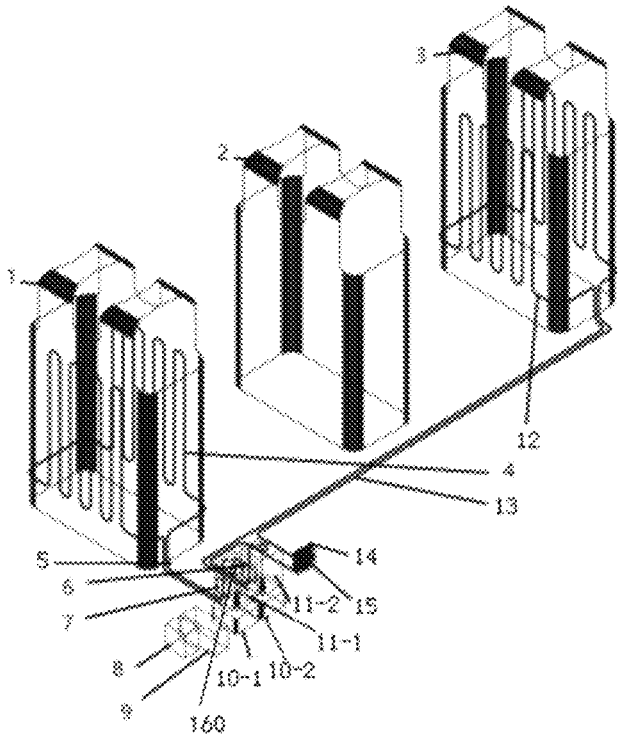
FIG. 2 is a schematic structural view of FIG. 1 with a cooling fan and a water-cooled radiator arranged additionally.

In the drawings: 1, thermostatic garment inner layer; 2, thermostatic garment heat insulating layer; 3, thermostatic garment outer layer; 4, first heat exchange water pipe network; 5, first connecting water pipe; 6, thermoelectric cooler; 61, N-type semiconductor; 62, P-type semiconductor; 63, upper heat conducting layer; 64, lower heat conducting layer; 65, conductive metal sheet; 7, electric heating sheet; 8, controller; 9, power supply; 10-1, first water pump; 10-2, second water pump; 11-1, first heat conducting water tank; 11-2, second heat conducting water tank; 12, second heat exchange water pipe network; 13, second connecting water pipe; 14, water-cooled radiator; 141, water-cooled radiator housing; 1411, connecting plate; 1412, accommodating chamber; 1413, water collecting area; 1414, water-cooled radiator water inlet; 1415, water-cooled radiator water outlet; 142, heat exchange module; 143, water inlet pipe; 144, water outlet pipe; 1441, water outlet side hole; 15, cooling fan; 16, ice (cold water) bag; 17, controller and power supply; 18, water supply port of water tank; 19, evaporator; 110, condenser; 120, fan; 130, refrigeration compressor; 140, electric heating wire network; 150, electric wire.

DETAILED DESCRIPTION OF THE EMBODIMENTS

The preferred embodiments of the present disclosure are described with reference to the drawings. It should be understood that the preferred embodiments are used to describe and illustrate the present disclosure rather than limit the present disclosure.

The embodiments of the present disclosure provide a thermostatic garment being heated and cooled by a power supply and includes a thermostatic garment body, the first heat exchange water pipe network 4, the second heat exchange water pipe network 12, the thermoelectric cooler 6, the electric heating sheet 7, the controller 8, the power supply 9, the first connecting water pipe 5, the second connecting water pipe 13, the water pump and the heat conducting water tank. The heat conducting water tank includes the first heat conducting water tank 11-1 and the second heat conducting water tank 11-2. The water pump includes the first water pump 10-1 and the second water pump 10-2.

The thermostatic garment body includes the thermostatic garment inner layer 1 and the thermostatic garment outer layer 3. The first heat exchange water pipe network 4 is arranged on the thermostatic garment inner layer 1 in a laying manner, and the second heat exchange water pipe network 12 is arranged on the thermostatic garment outer layer 3 in a laying manner. The thermoelectric cooler 6, the electric heating sheet 7, the controller 8, the power supply 9, the water pump and the heat conducting water tank are all arranged outside the thermostatic garment body.

The first heat conducting water tank 11-1 is further provided with a first temperature sensor 160, and the first temperature sensor 160 is arranged in the first heat conducting water tank 11-1 instead of the garment body so the garment body has no electric wires in order to assure safety while in use. The first temperature sensor 160 is electrically connected to an input end of the controller 8. The first temperature sensor 160, the thermoelectric cooler 6, the electric heating sheet 7, the controller 8, the first water pump 10-1, and the second water pump 10-2 are all connected to the power supply 9. Output ends of the controller 8 are further electrically connected to the thermoelectric cooler 6, the electric heating sheet 7, the first water pump 10-1 and the second water pump 10-2 respectively.

The thermoelectric cooler 6 can work in two work modes of heating and cooling. One of a cold end and a hot end of the thermoelectric cooler 6 is connected to the first heat conducting water tank 11-1, and another one of the cold end and the hot end of the thermoelectric cooler 6 is connected to the second heat conducting water tank 11-2. A water inlet end of the first water pump 10-1 is connected to a water outlet of the first heat conducting water tank 11-1. A water outlet end of the first water pump 10-1 is connected to one end of the first connecting water pipe 5 and another end of the first connecting water pipe 5 is connected to a water inlet of the first heat exchange water pipe network 4. A water outlet of the first heat exchange water pipe network 4 is connected to a water inlet of the first heat conducting water tank 11-1. The first heat conducting water tank 11-1 is further connected with the electric heating sheet 7. A water inlet end of the second water pump 10-2 is connected to a water outlet of the second heat conducting water tank 11-2. A water outlet end of the second water pump 10-2 is connected to one end of the second connecting water pipe 13 and another end of the second connecting water pipe 13 is connected to a water inlet of the second heat exchange water pipe network 12. A water outlet of the second heat exchange water pipe network 12 is connected to a water inlet of the second heat conducting water tank 11-2. A closed loop waterway is formed by the second heat conducting water tank 11-2, the second heat exchange water pipe network 12 and the second water pump 10-2. The water tank, the controller 8 and the water pump are integrated inside a small integrated control box, which can be carried around (in a pocket or hung around the waist). A power supply adopts standard 12V and 5V power supplies, which also can be carried around owing to their small size. The power supply and the aforementioned integrated control box are two separate units where the power supply supplies power to the integrated control box.

The thermoelectric cooler 6, also called semiconductor cooler, is a heat pump. The thermoelectric cooler has the advantage of no sliding parts and is used in situations with limited space and has high reliability and without refrigerant contamination. Using the Peltier effect of semiconductor materials, when a direct current is passed through a galvanic couple of two different semiconductor materials (e.g. P-type semiconductor 62 and N-type semiconductor 61) in series, heat can be respectively absorbed and released at both ends of the galvanic couple, thereby cooling is obtained. This is a refrigeration technology that produces negative thermal resistance, which is characterized by no moving parts and is high reliability.

The working principle and advantages of the above technical solution are as follows.

Cooling Operation Mode of the Thermostatic Garment:

A positive pole of the power supply 9 is connected to the N-type semiconductor 61 of the thermoelectric cooler 6, and a negative pole of the power supply 9 is connected to the P-type semiconductor 62 of the thermoelectric cooler 6. The thermoelectric cooler 6 absorbs heat on one side of the first heat conducting tank 11-1 connected to the thermostatic garment inner layer 1, thereby lowering the temperature of the water in the first heat conducting water tank 11-1. The cold water in the first heat conducting water tank 11-1 is driven by the first water pump 10-1 connected to the thermostatic garment inner layer 1 to circulate and flow in the first heat exchange water pipe network 4 of the thermostatic garment inner layer 1 through the first connecting water pipe 5, thereby removing body heat. At the same time, the thermoelectric cooler 6 is heated on one side of the second heat conducting water tank 11-2 connected to the thermostatic garment outer layer 3, thereby raising the temperature of the second heat conducting water tank 11-2. The hot water in the second heat conducting water tank 11-2 is driven by the second water pump 10-2 connected to the thermostatic garment outer layer 3 to circulate and flow in the second heat exchange water pipe network 12 of the thermostatic garment outer layer 3, and the heat dissipation effect is achieved by contacting outside air. The present technical solution has the advantages of good heat dissipation. The temperature of the water in the first heat conducting water tank 11-1 is monitored by the first temperature sensor 160 used by the controller 8, and the power supply of the thermoelectric cooler 6 is controlled (e.g. controlling the current direction and magnitude of the thermoelectric cooler 6) to obtain a constant temperature according to the water temperature.

Heating Operation Mode of the Thermostatic Garment:

The direction of the power supply of the thermoelectric cooler 6 is switched. The positive pole of the power supply is connected to the P-type semiconductor 62 of the thermoelectric cooler 6, and the negative pole of the power supply is connected to the N-type semiconductor 61 of the thermoelectric cooler 6. The thermoelectric cooler 6 is heated on one side connected to the first heat conducting water tank 11-1, thereby raising the temperature of the water in the first heat conducting water tank 11-1. The hot water in the first heat conducting water tank 11-1 is driven by the first water pump 10-1 connected to the thermostatic garment inner layer 1 to circulate and flow in the first heat exchange water pipe network 4 of the thermostatic garment inner layer 1 through the first connecting water pipe 5, thereby providing heat to the body. At the same time, the thermoelectric cooler 6 provides cooling on one side of the second heat conducting water tank 11-2, thereby lowering the temperature of the second heat conducting water tank 11-2. The cold water in the second heat conducting water tank 11-2 is driven by the second water pump 10-2 into the second heat exchange water pipe network 12 on the thermostatic garment outer layer 3 to circulate and flow, and the heat exchange is achieved by contacting the outside air. The temperature of the water in the first heat conducting water tank 11-1 is monitored by the first temperature sensor 160 used by the controller 8, and the power supply of the thermoelectric cooler 6 is controlled (e.g. controlling the current direction and magnitude of the refrigerant sheet 6) to obtain a constant temperature according to the water temperature.

Another heating operation mode of the thermostatic garment body:

The electric heating sheet 7 is heated by the power supply 9, thereby raising the temperature of the water in the first heat conducting water tank 11-1. The hot water in the first heat conducting water tank 11-1 is driven by the first water pump 10-1 to circulate and flow in the first heat exchange water pipe network 4 of the thermostatic garment inner layer 1 through the first connecting water pipe 5, thereby providing heat to the body. The temperature of the water in the first heat conducting water tank 11-1 is monitored by the first temperature sensor 160 used by the controller 8, and the power supply of the electric heating sheet 7 is controlled to obtain a constant temperature according to the water temperature.

In summary, the thermostatic garment of the present disclosure adopts a thermoelectric cooler 6 for cooling and heating and also can be heated by an electric heating sheet 7. The cooled or heated water is driven by the first water pump 10-1 to circulate in the first heat exchange water pipe network 4 arranged on the thermostatic garment inner layer 1, thereby achieving the function of cooling or heating the body. Due to the use of electric heating or cooling, it is not necessary to pre-install a large amount of water in the first heat conducting water tank 11-1, thereby reducing the volume and the weight of the water tank and making the thermostatic garment convenient to carry. The adopted thermoelectric cooler 6 and the electric heating sheet 7 has the advantages of small volume, light weight, no moving parts, high efficiency, stable and reliable operation, and further makes the thermostatic garment convenient to carry. In addition, when the thermoelectric cooler 6 is heated on one side of the second heat conducting tank 11-2, thereby raising the temperature of the second heat conducting tank 11-2. The hot water in the second heat conducting water tank 11-2 is driven by the second water pump 10-2 to circulate and flow in the second heat exchange water pipe network 12 and the heat is dissipated by contacting the outside air. The technical solution adopts water circulation for heat dissipation in the heat exchange water pipe network and has the advantages of good heat dissipation owing to the large contact area with the ambient air and not requiring the use of a fan for cooling, thereby reducing noise and improving reliability.

Figure 3:
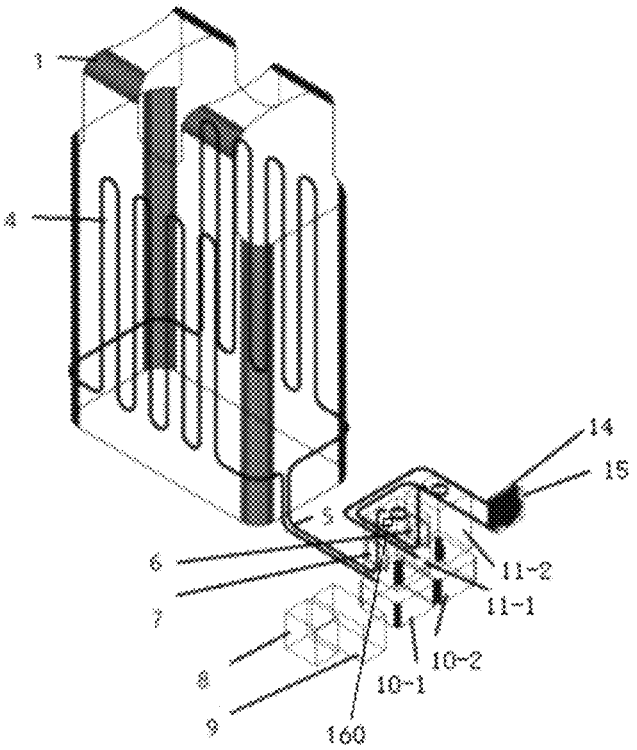
FIG. 3 is a schematic structural view of the present disclosure removing the thermostatic garment outer layer, the second heat exchange water pipe network and the second connecting water pipe, and with a cooling fan and a water-cooled radiator arranged additionally.

In one embodiment, as shown in FIG. 3, the thermostatic garment outer layer 3, the second heat exchange water pipe network 12 and the second connecting water pipe 13 can be removed, and the water-cooled radiator 14 and the cooling fan 15 are arranged additionally. The water-cooled radiator 14 and the cooling fan 15 are arranged in parallel, and the cooling fan 15 blows air toward the water-cooled radiator 14 to further cool the water-cooled radiator 14. The water-cooled radiator water inlet 1414 is connected to a water outlet end of the second water pump 10-2 through a water pipe, and a water inlet end of the second water pump 10-2 is connected to a water outlet of the second heat conducting water tank 11-2. The water-cooled radiator water outlet 1415 is connected to a water inlet of the second heat conducting water tank 11-2 through a water pipe. The cooling fan 15 is controlled by the controller 8 to operate. For example, by controlling a rotational speed of the cooling fan 15. A closed loop waterway is formed by the second heat conducting water tank 11-2, the water-cooled radiator 14 and the second water pump 10-2. This option is used when the ambient temperature is not high, and a certain heat dissipation effect can be achieved through the water-cooled radiator 14 and the cooling fan 15.

Figure 4:
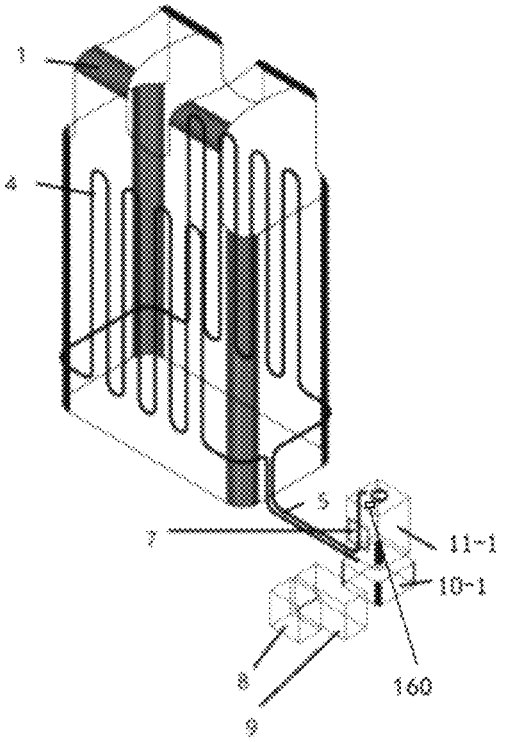
FIG. 4 is a schematic structural view of FIG. 3 with the second heat conducting water tank, the second water pump, the water-cooled radiator, the cooling fan and the thermoelectric cooler not being shown.
Figure 5:
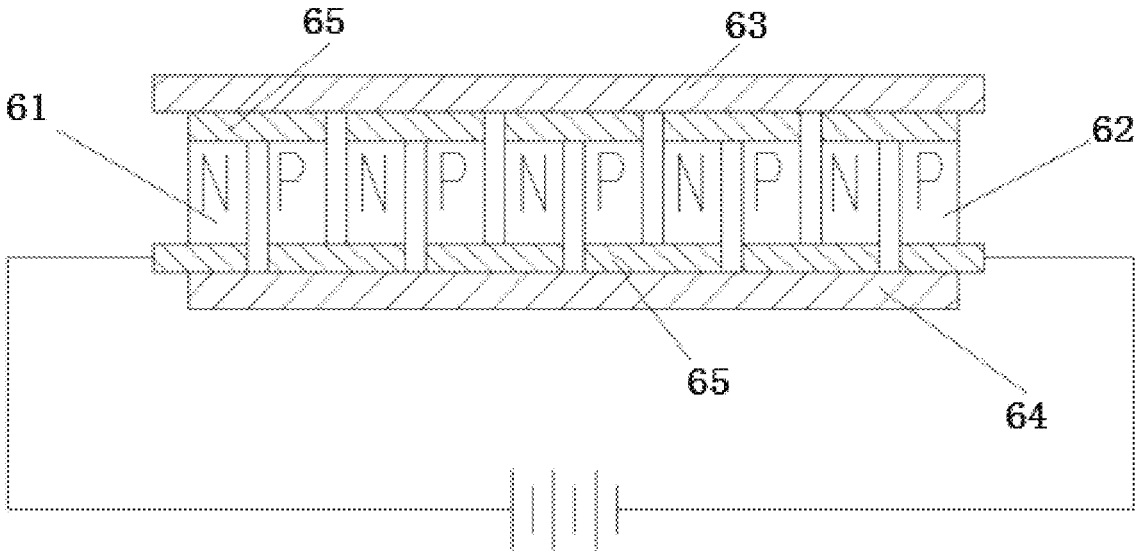
FIG. 5 is a schematic structural view of an embodiment of the thermoelectric cooler of the present disclosure.
Figure 6:
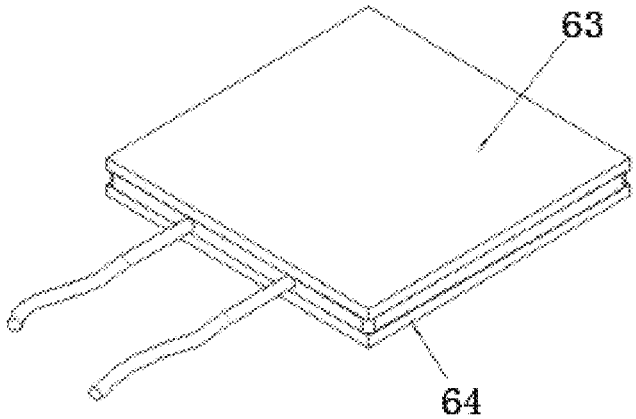
FIG. 6 is a schematic structural view of an embodiment of the thermoelectric cooler of the present disclosure.
Figure 7:
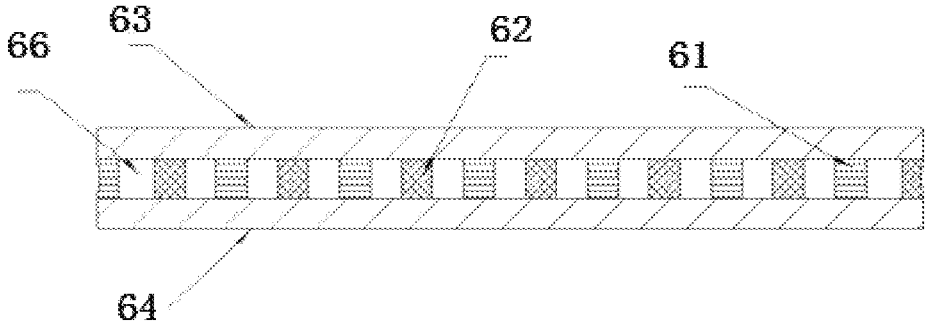
FIG. 7 is a full sectional view of FIG. 6.
Figure 8:
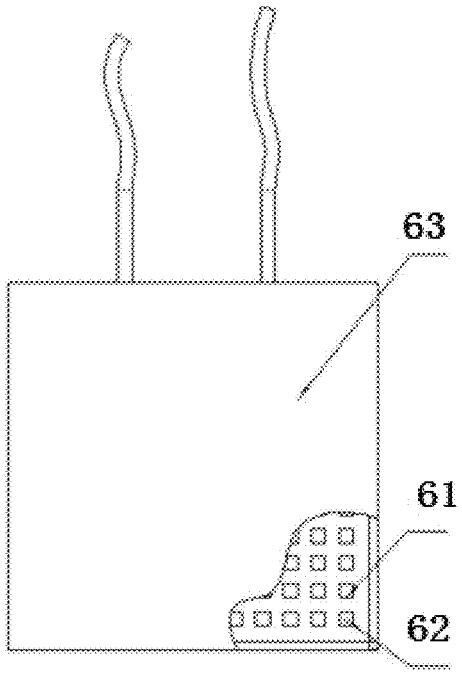
FIG. 8 is a partial sectional view of FIG. 6.
Figure 9:
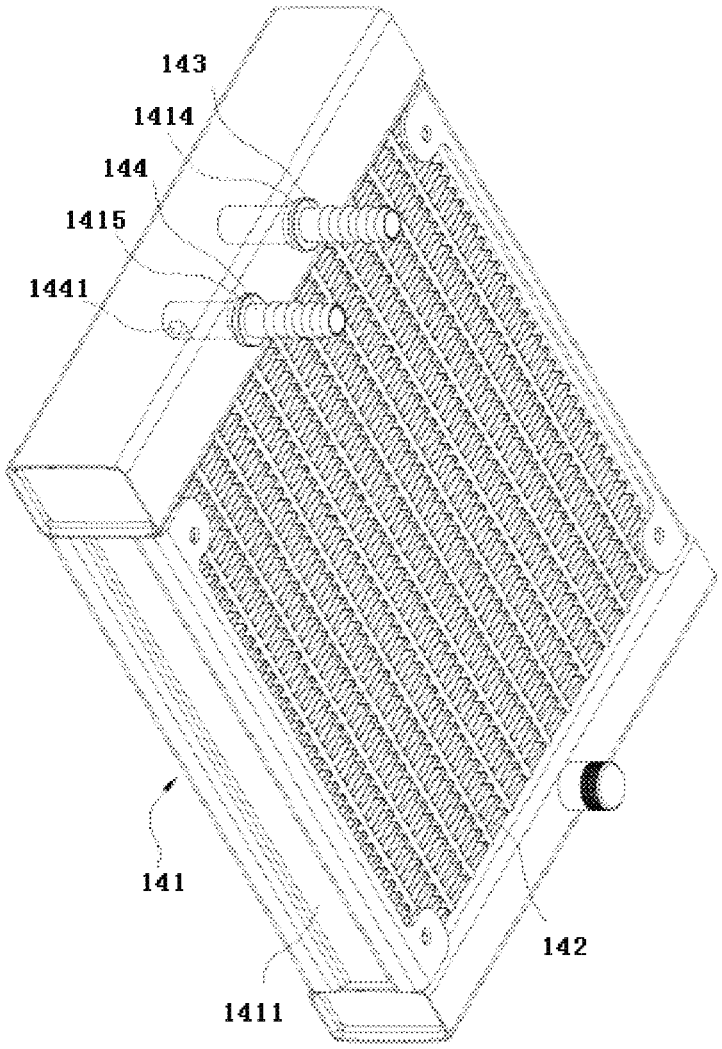
FIG. 9 is a schematic structural view of an embodiment of the water-cooled radiator of the present disclosure.
Figure 10:
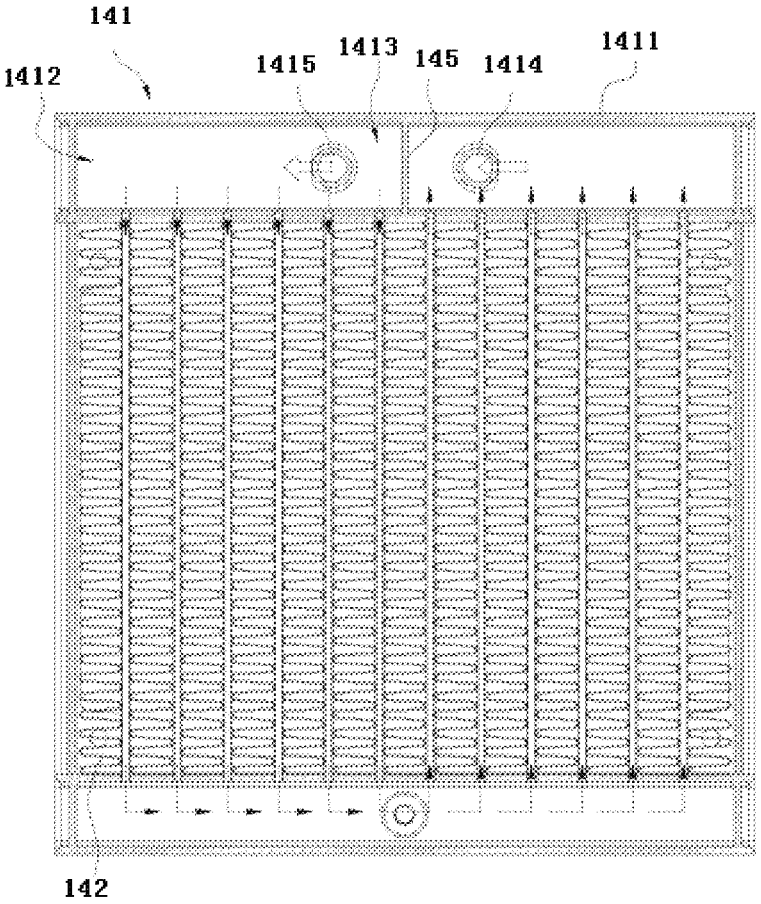
FIG. 10 is a top view of FIG. 9.
Figure 11:
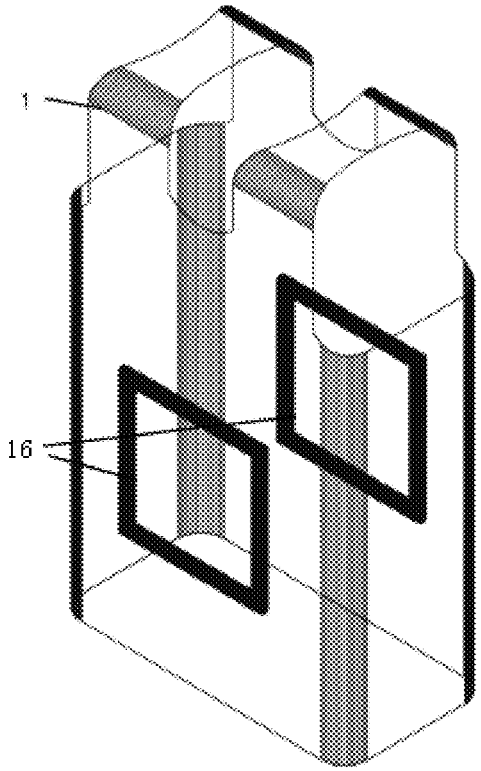
Fig. 11 (Prior Art)
FIG. 11 is a first technical solution in the prior art.
Figure 12:
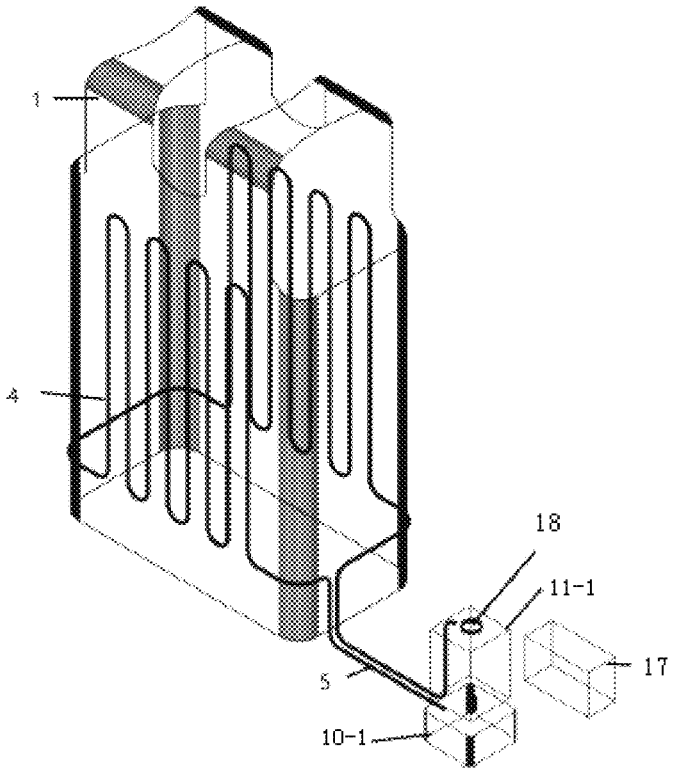
Fig. 12 (Prior Art)
FIG. 12 is a second technical solution in the prior art.
Figure 13:
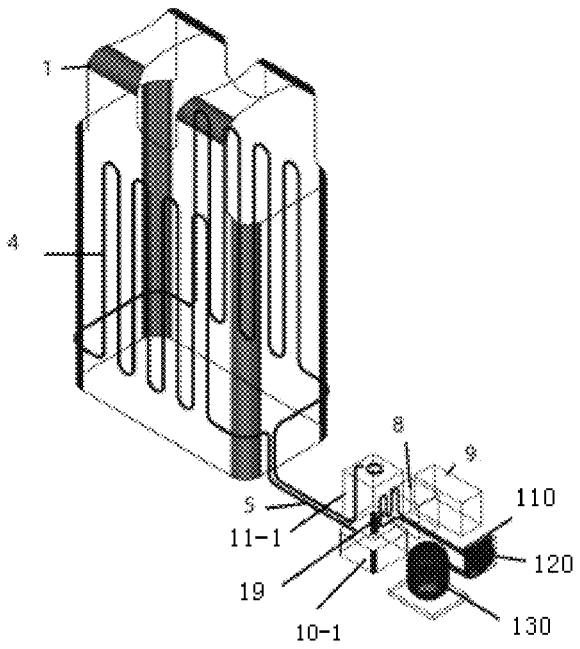
Fig. 13 (Prior Art)
FIG. 13 is a third technical solution in the prior art.
Figure 14:
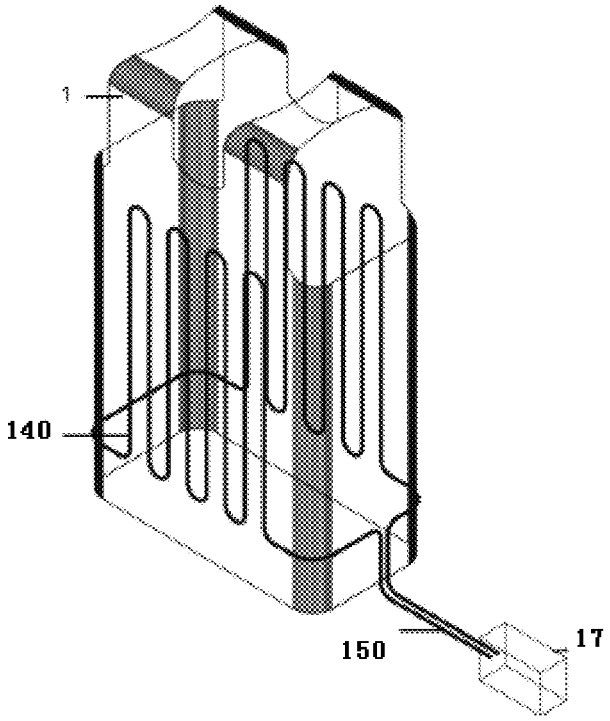
Fig. 14 (Prior Art)
FIG. 14 is a fourth technical solution in the prior art.

In one embodiment, as shown in FIG. 4, the second heat conducting water tank 11-2, the second water pump 10-2 and the thermoelectric cooler 6 can be removed. This option is used in an environment requiring only heating, and only the relevant heating components are retained. This embodiment reduces the weight and volume of the thermostatic garment.

In one embodiment, the thermostatic garment body further includes a thermostatic garment heat insulating layer 2. The thermostatic garment heat insulating layer 2 is arranged between the thermostatic garment inner layer 1 and the thermostatic garment outer layer 3.

The working principle and the beneficial effect of the above technical solution are as follows. The thermostatic garment heat insulating layer 2 is located between the thermostatic garment inner layer 1 and the thermostatic garment outer layer 3, thereby playing a role of heat insulation.

In one embodiment, the water-cooled radiator 14 and the cooling fan 15 are additionally arranged in series on one end of the second connecting water pipe 13 close to the second water pump 10-2. The water-cooled radiator water inlet 1414 is connected to the water outlet end of the second water pump 10-2 through a water pipe, and the water-cooled radiator 14 water outlet is connected to the water inlet of the second heat exchange water pipe network 12 through a water pipe. The cooling fan 15 and the water-cooled radiator 14 are arranged in parallel, and the cooling fan 15 is controlled to operate by the controller 8. For example, by controlling a rotational speed of the cooling fan 15.

The working principle and the beneficial effect of the above technical solution are as follows. The above structure is simple and the heat dissipation effect is further enhanced by providing the water-cooled radiator 15 and the cooling fan 14 in a special high temperature environment.

In one embodiment, the thermostatic garment further includes the thermoelectric cooler driving circuit 6, wherein an input end of the controller 8 is connected to the first temperature sensor 160, and an output end of the controller 8 is connected to an input end of the thermoelectric cooler 6 driving circuit. An output end of the thermoelectric cooler 6 driving circuit is connected to the thermoelectric cooler 6.

A first preset temperature signal is preset and stored by the controller 8. A temperature signal collected by the first temperature sensor 160 is compared with the first preset temperature signal by the controller 8. The direction and magnitude of an electric current flowing into the thermoelectric cooler 6 is controlled by software according to a comparison result.

The first temperature sensor 160 is a PT100 temperature sensor or a digital temperature sensor. The PT100 temperature sensor has a small volume, a fast temperature measurement reaction and an accurate temperature measurement.

The second water pump 10-2 driving circuit and the cooling fan 15 driving circuit, wherein the input end of the second water pump 10-2 driving circuit and the input end of the cooling fan 15 driving circuit are both connected to output ends of the controller 8. An output end of the second water pump 10-2 driving circuit is connected to the second water pump 10-2. The output end of the cooling fan 15 driving circuit is connected to the cooling fan 15.

The working principle and the beneficial effect of the above technical solution are as follows.

The direction and magnitude of the current flowing into the thermoelectric cooler 6 are controlled by software, and a rotation speed of the cooling fan 15 and the current of the second water pump 10-2 is controlled by the controller, which is convenient in control.

In one embodiment, the water-cooled radiator includes:

the water-cooled radiator housing 141, wherein the water-cooled radiator housing 141 includes the plurality of connecting plates 1411. The plurality of connecting plates 1411 form an accommodating chamber 1412. The water-cooled radiator housing 141 has the water collecting area 1413 on a side of the accommodating chamber 1412, wherein one of the connecting plates 1411 is provided with the water-cooled radiator water inlet 1414 and the water-cooled radiator water outlet 1415. The water-cooled radiator water inlet 1414 and the water-cooled radiator water outlet 1415 are arranged in the water collecting area 1413. The water-cooled radiator water inlet 1414 and the water-cooled radiator water outlet 1415 are both in communication with the accommodating chamber 1412;

the heat exchange module 142, wherein the heat exchange module 142 is arranged in the accommodating chamber 1412, and the heat exchange module 142 include a plurality of wavy cooling fins;

the water inlet pipe 143, wherein the water inlet pipe 143 is inserted in the water-cooled radiator water inlet 1414. One end of the water inlet pipe 143 is exposed outside the water-cooled radiator housing 141 and another end of the water inlet pipe 143 extends from the water-cooled radiator water inlet 1414 into the accommodating chamber 1412;

the water outlet pipe 144, wherein the water outlet pipe 144 is inserted in the water-cooled radiator water outlet 1415. One end of the water outlet pipe 144 is exposed outside the water-cooled radiator housing 141 and another end of the water inlet pipe 143 extends from the water-cooled radiator water outlet 1415 into the accommodating chamber 1412. The water outlet pipe 144 has the water outlet side hole 1441 at an end extending into the accommodating chamber 1412. A structure of the water-cooled radiator can prevent air from entering the water outlet pipe 144 by covering the water outlet side hole 1441 through the water in the accommodating chamber 1412;

a partition plate 145, wherein the partition plate 145 is arranged in the accommodating chamber 1412 and located between the water inlet pipe 143 and the water outlet pipe 144. Two opposite inner wall surfaces of the accommodating chamber 1412 are connected by the partition plate 145.

The working principle and the beneficial effect of the above technical solution are as follows. In the above structure, the inlet pipe 143 is formed in the water collecting area 1413, so the water in the water collecting area 1413 can flow from the water inlet pipe 143 into the heat exchange area. In this arrangement, the water tank can be arranged at different angles and directions without influencing the conveying of the water to the heat exchange area, and the water in the water collecting area 1413 only needs to cover the water outlet side hole 1441 of the water outlet pipe 144 to prevent air from entering the water outlet pipe 144. That is preventing the air from being sucked into the water pump and thereby keeping the water pump running normally.

In one embodiment, the thermoelectric cooler 6 includes an array structure formed by the plurality of P-type semiconductors 62 and the plurality of N-type semiconductors connected 61 in series, wherein the P-type semiconductors 62 and the N-type semiconductors 61 are spaced apart. The P-type semiconductors 62 and the N-type semiconductors 61 adjacent to each other have no contact; and the upper heat conducting layer 63 and the lower heat conducting layer 64 are arranged opposite to each other. A material of the upper heat conducting layer 63 and the lower heat conducting layer 64 may be both alumina ceramic. The alumina ceramic has good heat conduction, good heat dissipation effect, a high heat conducting coefficient, good stability, and safety due to the insulation. The upper heat conducting layer 63 and the lower heat conducting layer 64 are respectively additionally arranged on an upper end and a lower end of the array structure. The upper heat conducting layer 63 is fixedly connected with at least one conductive metal sheet 65. The lower heat conducting layer 64 is fixedly connected with at least two conductive metal sheets 65, and the number of the conductive metal sheets 65 fixedly connected to the lower heat conducting layer 64 is one more than the number of the conductive metal sheets 65 fixedly connected to the upper heat conducting layer 63. The N-type semiconductor 61 and the P-type semiconductor 62 are fixed on each of the conductive metal sheets 65 on the upper heat conducting layer 63. Other ends of the N-type semiconductor 61 element and the P-type semiconductor 62 element fixed on the same conductive metal sheet 65 on the upper heat conducting layer 63 are respectively fixed on two adjacent conductive metal sheets 65 on the lower heat conducting layer 64. The conductive metal sheets 65 on the left and right ends of the lower heat conducting layer 64 are connected to the positive and negative poles of the direct current power supply 9. Ends of the upper heat conducting layer 63 and the lower heat conducting layer 64, away from the array structure, are respectively connected to the first heat conducting water tank 11-1 and the second heat conducting water tank 11-2.

The working principle and the beneficial effect of the above technical solution are as follows. The above structure is simple and is convenient to control the cooling sheet to perform cooling or heating by changing the current flow direction.

In one embodiment, a closed accommodating space is formed between the upper heat conducting layer and the lower heat conducting layer. The corresponding edges of the upper heat conducting layer and the lower heat conducting layer are bonded. The array structure is located in the accommodating space and in the array structure. The plurality of P-type semiconductors 62 and the plurality of N-type semiconductors 61 are collinearly arranged along an arrangement direction of the array. The P-type semiconductors 62 and the N-type semiconductors 61 are spaced apart in the accommodating space. A first gap is arranged between the adjacent P-type semiconductors 62 and the N-type semiconductors 61. A second gap is formed between the adjacent P-type semiconductors 62. A third gap is formed between the adjacent N-type semiconductors 61. An inert gas is filled in the first gap, the second gap and the third gap. The inert gas (for example, argon) refers to a group 18 element on the periodic table.

The working principle and the beneficial effect of the above technical solution are as follows. An inert gas is filled in the accommodating space between the upper heat conducting layer 63 and the lower heat conducting layer 64 in the above technical solution. The heat conducting layer 63 and the lower heat conducting respectively perform cooling and heating. The above technology can be used to cut off the heat exchange between the upper heat conducting layer 63 and the lower heat conducting layer 64, so as to improve the cooling efficiency of the cooling layer and the heating efficiency of the heating layer, leading to good cooling and heating effects.

One embodiment further includes an electronic device. The electronic device includes:

a liquid crystal display panel;

an up selection button, a down selection button and a confirmation button. The up selection button, the down selection button and the confirmation button are all hard buttons.

a microprocessor, liquid crystal display panel, the up selection button, the down selection button, the confirmation button and the controller are all connected to the microprocessor; and the microprocessor selects the functions of heating, cooling, water pumping and fanning and sets a target temperature in the menu by the up selection button, down selection button and confirmation button. The microprocessor displays information of menu options, set temperature, actual temperature and current operating status via the liquid crystal display panel.

The working principle and advantages of the above technical solutions are as follows. Users select the functions of heating, cooling, water pumping and fanning and sets a target temperature in the menu through the up selection button, the down selection button and the confirmation button. A control signal corresponding to a button is input to the microprocessor after being selected. For example, after the cooling option in the menu is triggered and the target temperature is set by the button, the microprocessor outputs a control signal for controlling the thermoelectric cooler 6 to the controller by comparing the actual temperature detected by the first temperature sensor 160 with the set target temperature, and simultaneously outputs a first water pump 10-1 control signal and a second water pump 10-2 control signal to the controller. The thermoelectric cooler 6, the first water pump 10-1 and the second water pump 10-2 are controlled to operate by the controller. After the heating option in the menu is triggered and the target temperature is set by the button, the microprocessor outputs a control signal for controlling the thermoelectric cooler 6 or controlling the electric heating sheet 7 by comparing the actual temperature detected by the first temperature sensor 160 with the set target temperature, and simultaneously outputs a first water pump 10-1 control signal to the controller. The thermoelectric cooler 6 or the electric heating sheet 7 and the first water pump 10-1 are controlled to operate by the controller. As can be seen by the above technical solution, people are able to control operations of the thermoelectric cooler 6, the electric heating sheet 7, the first water pump 10-1 and the second water pump 10-2 simply by operating the electronic device, thereby making it convenient to control and use the thermostatic garment.

It is obvious that those skilled in the art can make various modifications and variations to the present disclosure without departing from the spirit and scope of the present disclosure. Therefore, if such modifications and variations of the present disclosure fall within the scope of the claims and equivalent technology thereof, the present disclosure is also intended to cover such modifications and variations.

What is claimed is:

1. A thermostatic garment comprising:

a thermostatic garment body, a first heat exchange water pipe network, a second heat exchange water pipe network, a thermoelectric cooler, an electric heating sheet, a controller, a power supply, a first connecting water pipe, a second connecting water pipe, a water pump, and a heat conducting water tank;

wherein the heat conducting water tank comprises a first heat conducting water tank and a second heat conducting water tank; the water pump comprises a first water pump and a second water pump;

the thermostatic garment body comprises a thermostatic garment inner layer and a thermostatic garment outer layer; the first heat exchange water pipe network is arranged on the thermostatic garment inner layer in a laying manner, and the second heat exchange water pipe network is arranged on the thermostatic garment outer layer in the laying manner; the thermoelectric cooler, the electric heating sheet, the controller, the power supply, the water pump and the heat conducting water tank are all arranged outside the thermostatic garment body;

the first heat conducting water tank is further provided with a first temperature sensor and the first temperature sensor is electrically connected to an input end of the controller; the first temperature sensor, the thermoelectric cooler, the electric heating sheet, the controller, the first water pump and the second water pump are all connected to the power supply; output ends of the controller are further electrically connected to the thermoelectric cooler, the electric heating sheet, the first water pump and the second water pump respectively; and the thermoelectric cooler works in two work modes of heating and cooling, one of a cold end and a hot end of the thermoelectric cooler is connected to the first heat conducting water tank, and another one of the cold end and the hot end of the thermoelectric cooler is connected to the second heat conducting water tank; a water inlet end of the first water pump is connected to a water outlet of the first heat conducting water tank, a water outlet end of the first water pump is connected to a first end of the first connecting water pipe, a second end of the first connecting water pipe is connected to a water inlet of the first heat exchange water pipe network, a water outlet of the first heat exchange water pipe network is connected to a water inlet of the first heat conducting water tank, the first heat conducting water tank is further connected to the electric heating sheet, a water inlet end of the second water pump is connected to a water outlet of the second heat conducting water tank, a water outlet end of the second water pump is connected to a first end of the second connecting water pipe, a second end of the second connecting water pipe is connected to a water inlet of the second heat exchange water pipe network, a water outlet of the second heat exchange water pipe network is connected to a water inlet of the second heat conducting water tank; a closed loop waterway is formed by the second heat conducting water tank, the second heat exchange water pipe network and the second water pump.

2. The thermostatic garment according to claim 1, wherein, the thermostatic garment body further comprises a thermostatic garment heat insulating layer, and the thermostatic garment heat insulating layer is arranged between the thermostatic garment inner layer and the thermostatic garment outer layer.

3. The thermostatic garment according to claim 2, wherein, a water-cooled radiator and a cooling fan are additionally arranged in series on a third end of the second connecting water pipe close to the second water pump, a water inlet of the water-cooled radiator is connected to the water outlet end of the second water pump through a first water pipe, a water outlet of the water-cooled radiator is connected to the water inlet of the second heat exchange water pipe network through a second water pipe, the cooling fan and the water-cooled radiator are arranged in parallel, and the cooling fan is controlled to operate by the controller.

4. The thermostatic garment according to claim 3, further comprising:

a thermoelectric cooler driving circuit, wherein the input end of the controller is connected to the first temperature sensor, an output end of the controller is connected to an input end of the thermoelectric cooler driving circuit, an output end of the thermoelectric cooler driving circuit is connected to the thermoelectric cooler;

a first preset temperature signal is preset and stored by the controller, a temperature signal collected by the first temperature sensor is compared with the first preset temperature signal by the controller, a direction and a magnitude of an electric current flowing into the thermoelectric cooler is controlled by a software according to a comparison result; and a second water pump driving circuit and a cooling fan driving circuit, wherein an input end of the second water pump driving circuit and an input end of the cooling fan driving circuit are connected to the output ends of the controller, an output end of the second water pump driving circuit is connected to the second water pump, an output end of the cooling fan driving circuit is connected to the cooling fan.

5. The thermostatic garment according to claim 1, wherein, a water-cooled radiator and a cooling fan are additionally arranged in series on a third end of the second connecting water pipe close to the second water pump, a water inlet of the water-cooled radiator is connected to the water outlet end of the second water pump through a first water pipe, a water outlet of the water-cooled radiator is connected to the water inlet of the second heat exchange water pipe network through a second water pipe, the cooling fan and the water-cooled radiator are arranged in parallel, and the cooling fan is controlled to operate by the controller.

6. The thermostatic garment according to claim 5, further comprising:

a thermoelectric cooler driving circuit, wherein the input end of the controller is connected to the first temperature sensor, an output end of the controller is connected to an input end of the thermoelectric cooler driving circuit, an output end of the thermoelectric cooler driving circuit is connected to the thermoelectric cooler;

a first preset temperature signal is preset and stored by the controller, a temperature signal collected by the first temperature sensor is compared with the first preset temperature signal by the controller, a direction and a magnitude of an electric current flowing into the thermoelectric cooler is controlled by a software according to a comparison result; and a second water pump driving circuit and a cooling fan driving circuit, wherein an input end of the second water pump driving circuit and an input end of the cooling fan driving circuit are connected to the output ends of the controller, an output end of the second water pump driving circuit is connected to the second water pump, an output end of the cooling fan driving circuit is connected to the cooling fan.

7. The thermostatic garment according to claim 5, wherein, the water-cooled radiator comprises:

a water-cooled radiator housing, wherein the water-cooled radiator housing comprises a plurality of connecting plates, and the plurality of connecting plates form an accommodating chamber, the water-cooled radiator housing comprises a water collecting area on a side of the accommodating chamber, wherein one of the plurality of connecting plates is provided with a water-cooled radiator water inlet and a water-cooled radiator water outlet, the water-cooled radiator water inlet and the water-cooled radiator water outlet are arranged in the water collecting area, and the water-cooled radiator water inlet and the water-cooled radiator water outlet are both in communication with the accommodating chamber;

a heat exchange module, wherein the heat exchange module is arranged in the accommodating chamber, and the heat exchange module comprises a plurality of wavy cooling fins;

a water inlet pipe, wherein the water inlet pipe is inserted in the water-cooled radiator water inlet, a first end of the water inlet pipe is exposed outside the water-cooled radiator housing, a second end of the water inlet pipe extends from the water-cooled radiator water inlet into the accommodating chamber;

a water outlet pipe, wherein the water outlet pipe is inserted in the water-cooled radiator water outlet, a first end of the water outlet pipe is exposed outside the water-cooled radiator housing, a second end of the water inlet pipe extends from the water-cooled radiator water outlet into the accommodating chamber, the water outlet pipe comprises a water outlet side hole at an end extending into the accommodating chamber, a structure of the water-cooled radiator prevents air from entering the water outlet pipe by covering the water outlet side hole through water in the accommodating chamber; and a partition plate, wherein the partition plate is arranged in the accommodating chamber and located between the water inlet pipe and the water outlet pipe, two opposite inner wall surfaces of the accommodating chamber are connected by the partition plate.

8. The thermostatic garment according to claim 1, wherein, the thermoelectric cooler comprises:

an array structure formed by a plurality of P-type semiconductors and a plurality of N-type semiconductors connected in series, wherein the plurality of P-type semiconductors and the plurality of N-type semiconductors are spaced apart, and the plurality of P-type semiconductors and the plurality of N-type semiconductors adjacent to each other do not contact each other;

an upper heat conducting layer and a lower heat conducting layer arranged opposite to each other, wherein the upper heat conducting layer and the lower heat conducting layer are additionally arranged on an upper end of the array structure and a lower end of the array structure respectively, the upper heat conducting layer is fixedly connected to at least one conductive metal sheet, the lower heat conducting layer is fixedly connected to at least two conductive metal sheets, and a number of the conductive metal sheets fixedly connected to the lower heat conducting layer is one more than a number of the conductive metal sheets fixedly connected to the upper heat conducting layer, a first end of one N-type semiconductor of the plurality of N-type semiconductors and a first end of one P-type semiconductor of the plurality of P-type semiconductors are fixed on each of the conductive metal sheets on the upper heat conducting layer, and a second end of the one N-type semiconductor element and a second end of the one P-type semiconductor are respectively fixed on two adjacent conductive metal sheets on the lower heat conducting layer, the conductive metal sheets on a left end of the lower heat conducting layer and a right end of the lower heat conducting layer are connected to a positive pole of a direct current power supply and a negative pole of the direct current power supply, ends of the upper heat conducting layer and the lower heat conducting layer away from the array structure are respectively connected to the first heat conducting water tank and the second heat conducting water tank.

9. The thermostatic garment according to claim 8, wherein, a closed accommodating space is formed between the upper heat conducting layer and the lower heat conducting layer, corresponding edges of the upper heat conducting layer and the lower heat conducting layer are bonded, the array structure is located in the closed accommodating space, and in the array structure: the plurality of P-type semiconductors and the plurality of N-type semiconductors are collinearly arranged along an arrangement direction of the array structure, the plurality of P-type semiconductors and the plurality of N-type semiconductors are spaced apart in the closed accommodating space, a first gap is arranged between the each of the plurality of P-type semiconductors and each of the plurality of N-type semiconductors adjacent to each other, a second gap is formed between adjacent P-type semiconductors of the plurality of P-type semiconductors, a third gap is formed between adjacent N-type semiconductors of the plurality of N-type semiconductors, an inert gas is filled in the first gap, the second gap and the third gap.

10. The thermostatic garment according to claim 9, wherein, materials of the upper heat conducting layer and the lower heat conducting layer is alumina ceramic.

11. The thermostatic garment according to claim 8, wherein, materials of the upper heat conducting layer and the lower heat conducting layer are alumina ceramic.

12. The thermostatic garment according to claim 1, further comprising an electronic device, wherein the electronic device comprises:

a liquid crystal display panel;

an up selection button, a down selection button, and a confirmation button, wherein the up selection button, the down selection button and the confirmation button are all hard buttons; and a microprocessor, wherein the liquid crystal display panel, the up selection button, the down selection button, the confirmation button and the controller are all connected to the microprocessor.

* * * * *